US005699959A

United States Patent [19]

Huspeka et al.

[11] Patent Number: 5,699,959

[45] Date of Patent: Dec. 23, 1997

[54] CONTAINER WITH INTERLOCKING LID

[75] Inventors: John A. Huspeka, Mississauga; Peter L. Calcagni, Burlington, both of Canada

[73] Assignee: Dover Industries Limited, Ontario, Canada

[21] Appl. No.: 719,495

[22] Filed: Sep. 25, 1996

[51] Int. Cl.[6] ..... B65D 43/10

[52] U.S. Cl. ..... 229/125.26; 229/125.28; 229/182

[58] Field of Search ..... 229/125.26, 125.28, 229/149, 150, 167, 168, 182; 220/786–790, 794, 799, 802

[56] References Cited

U.S. PATENT DOCUMENTS

| | | | |
|---|---|---|---|
| 1,239,223 | 9/1917 | Ross | 220/786 |
| 1,910,074 | 5/1933 | Wells | 220/794 |
| 2,939,624 | 6/1960 | Wilson | 229/125.28 |
| 4,259,827 | 4/1981 | Stohlquist | 229/125.26 |
| 4,291,829 | 9/1981 | VanderLugt, Jr. | 229/182 |
| 5,005,759 | 4/1991 | Bouche | 229/125.26 |
| 5,205,477 | 4/1993 | Zimmermann | 229/125.26 |

FOREIGN PATENT DOCUMENTS

| | | | |
|---|---|---|---|
| 2444416 | 4/1976 | Germany | 229/125.28 |

*Primary Examiner*—Gary E. Elkins
*Attorney, Agent, or Firm*—Barrigar & Moss

[57] ABSTRACT

An interlocking container and lid assembly and a partially formed container therefor is disclosed, wherein the container has a peripheral sidewall including an upper peripheral edge portion having at least two opposed interlocking areas. Openings are formed in the sidewall interlocking areas. Folded-back flaps are connected to the upper peripheral edge portion. The flaps have an upper wall portion covering the openings and a lower wall portion attached to the sidewall. The upper wall portion is spaced from the sidewall to form a hollow space behind the openings. The lid has a top member and a peripheral flange with projections formed therein to fit into the container sidewall openings and lock the lid onto the container.

17 Claims, 4 Drawing Sheets

CONTAINER WITH INTERLOCKING LID

FIELD OF THE INVENTION

This invention relates to cartons or containers with interlocking lids.

BACKGROUND OF THE ART

In the packaging of food products, it is often desirable to have a separate container and lid therefor, so that the container can be filled with the desired food product and the lid placed on the container after it is filled. Naturally, it is necessary that the lid be securely attached to the container until the contents of the container are ready to be removed. Preferably, the lid is removable and re-attachable, so that the contents of the container can be partially removed and the lid reattached to preserve the remainder of the contents in the container.

Food containers are often made of cardboard which is suitably coated to preserve freshness. In these cardboard food containers, reinforcing or strengthening flaps are often formed around the peripheral edges of the open end of the container. Similarly, the lids usually have peripheral edges which are doubled over with flaps for reinforcement. These flaps are normally glued down. Sometimes, these folded over flaps also form catching edges that are used to hook the lid onto the container. A difficulty with this construction, however, is that the cardboard is so thin and flexible that the catching edges do not hold.

Attempts have been made to improve the holding power of the inter-engaging edges on these peripheral edge flaps. An example of this is shown in U.S. Pat. No. 5,205,477 issued to Zimmermann. This patent takes advantage of the springiness or resilience of the cardboard material near the folded over peripheral edges of the container and the lid by forming slits or slots in the flaps adjacent to the peripheral edges, so that the edges of the slits or slots bow outwardly to increase the interference between the engaging edges on the container and the lid. A difficulty with this Zimmermann construction, however, is that it relies upon the springiness or tension in the cardboard material to make the interlocking slit edges bow out. This springiness or tension can easily be lost by overfilling the container or by using the container for products such as ice cream or other frozen foods. Further, the Zimmermann construction would not work with a container or lid made of other material such as plastic, since the peripheral edges of the slits or slots would not bow out.

SUMMARY OF THE INVENTION

In the present invention, pre-formed projections fit into cavities formed by stepped, folded-back flaps to give a positive interlock regardless of the material used for the container and lid and regardless of the product with which the container is filled.

According to one aspect of the invention, there is provided an interlocking container and lid comprising a tubular container having a peripheral sidewall and a bottom closure. The sidewall includes an upper peripheral edge portion having at least two opposed interlocking areas. Folded-back flaps are connected to the upper peripheral edge portion and extend over the interlocking areas. The flaps include an upper wall portion spaced from the sidewall and a lower wall portion adhesively attached to the sidewall. Means are provided defining an opening in one of the upper wall portion and the upper peripheral edge portion in each of the opposed interlocking areas. Also, a container lid is provided having a top member and a peripheral flange adapted to telescopically engage the container sidewall upper peripheral edge portion. The peripheral flange includes opposed projections adapted to pass through the openings to retain the lid on the container.

According to another aspect of the invention, there is provided a partially formed container comprising a tubular, collapsed container having a peripheral sidewall including lower, hingeably mounted flaps adapted to fold inwardly and overlap to form a bottom closure upon expansion of the collapsed container. The sidewall includes an upper peripheral edge portion having at least two opposed interlocking areas upon expansion of the collapsed container. Folded-back flaps connected to the upper peripheral edge portion extend over the interlocking areas. The flaps include an upper wall portion spaced from the sidewall and a lower wall portion adhesively attached to the sidewall. Also, means are provided defining an opening in one of the upper wall portion and the upper peripheral edge portion in each of the opposed interlocking areas.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
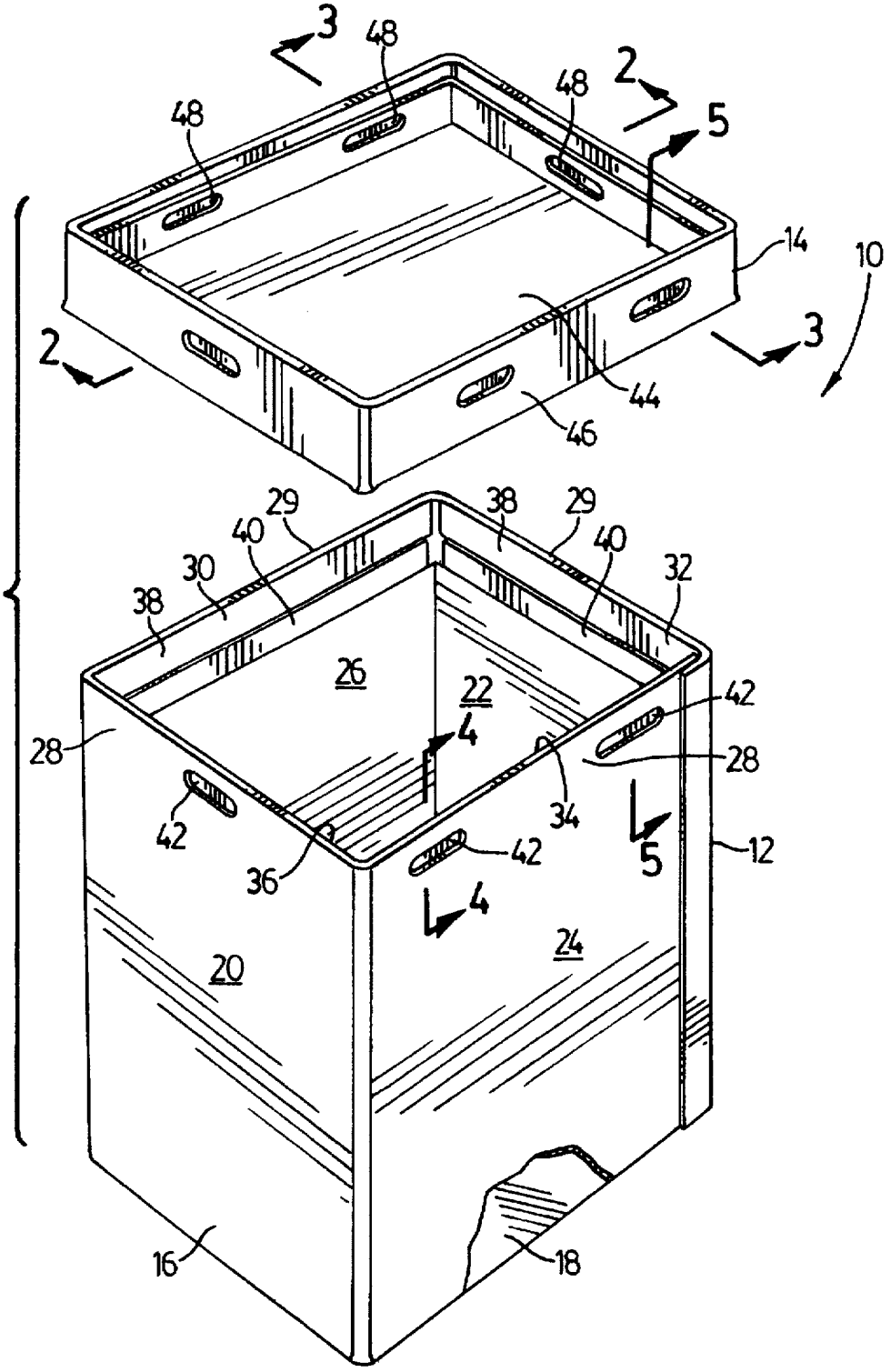
FIG. 1 is an exploded, perspective view of a preferred embodiment of an interlocking container and lid.
Figure 2:
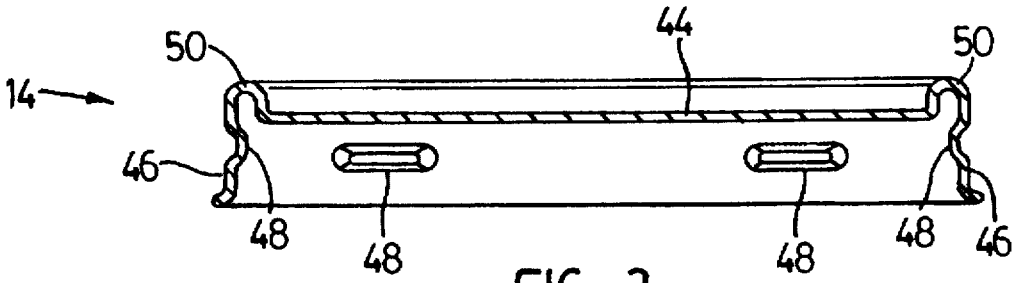
FIG. 2 is a sectional view taken along lines 2—2 of FIG. 1.
Figure 3:
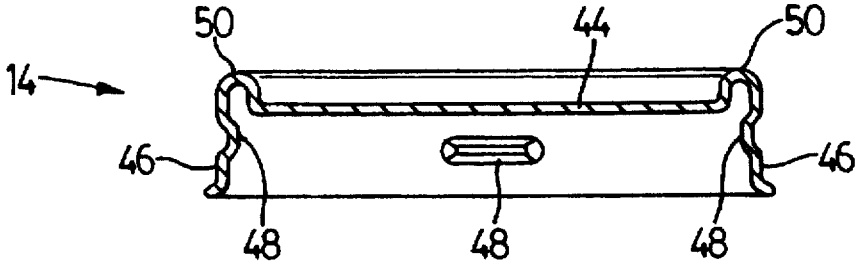
FIG. 3 is a sectional view taken along lines 3—3 of FIG. 1.
Figure 4:
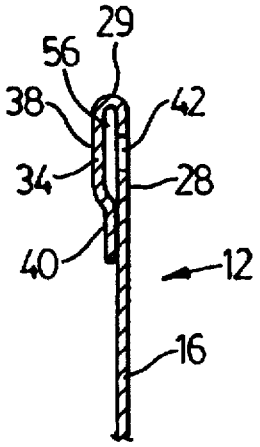
FIG. 4 is a partial sectional view taken along lines 4—4 of FIG. 1.
Figure 6:
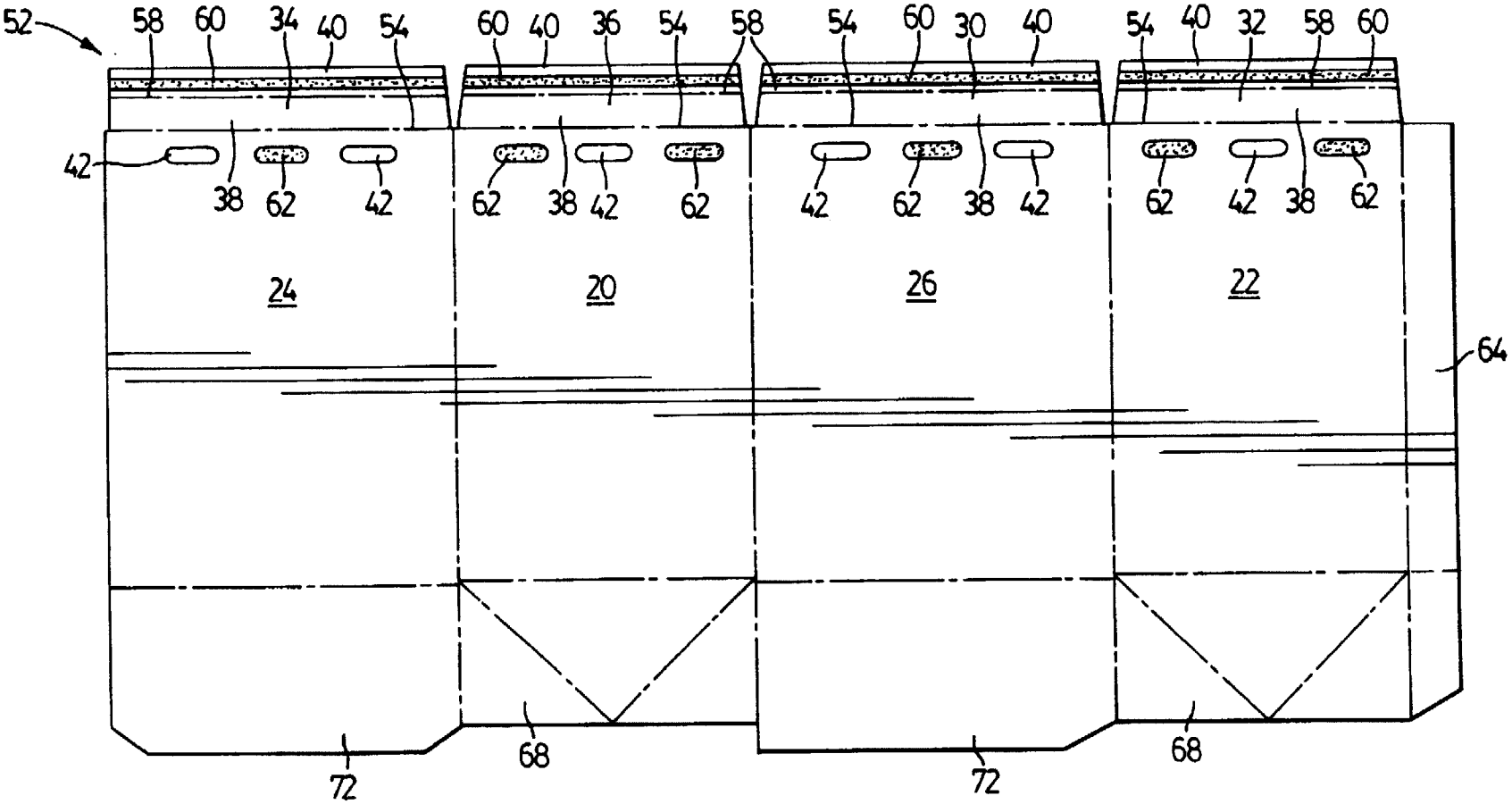
FIG. 6 is a plan view of the blank used to form the container of FIG. 1.
Figure 7:
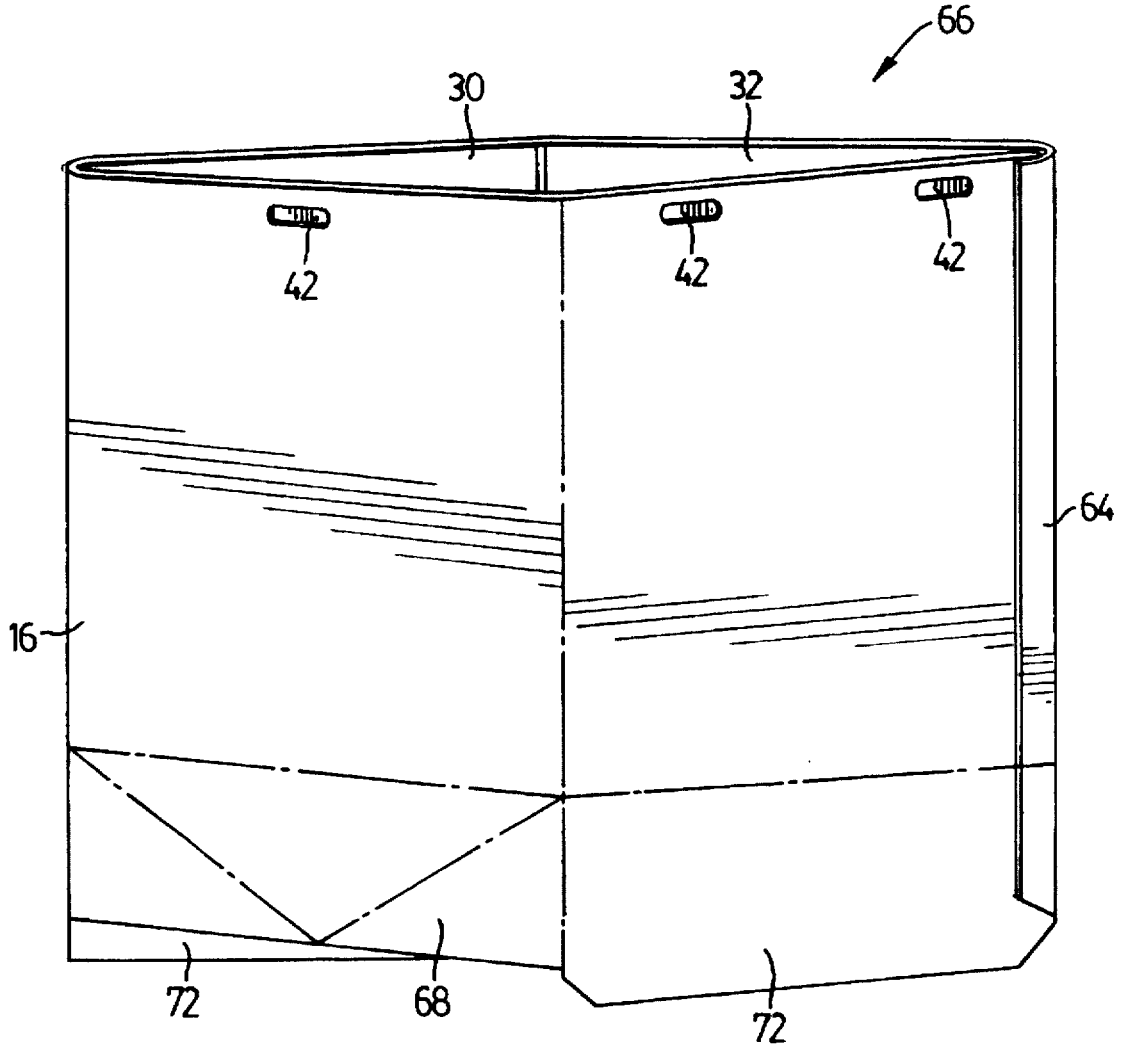
FIG. 7 is a perspective view of a partially formed container used to make the container of FIG. 1.

Referring firstly to FIGS. 1 to 5, a preferred embodiment of an interlocking container and lid assembly is generally represented in FIG. 1 by reference numeral 10. Assembly 10 includes a container 12 and a lid 14. Container 12 includes a peripheral sidewall 16 and a bottom closure 18. One type of bottom closure is shown in FIGS. 6 and 7 and will be described in further detail below, but any type of folding carton bottom closure could be used with container 12 as will be appreciated by those skilled in the art. The particular type of bottom closure used with container 12 is not considered to be part of the present invention apart from the fact that container 12 needs a bottom closure to be a container.

Container 12 is rectangular having two pairs of opposed side panels; one pair including panels 20 and 22 and the other pair including panels 24 and 26. Sidewall 16 includes an upper peripheral edge portion 28 having a top peripheral edge 29. Folded-back flaps 30, 32, 34 and 36 are connected to upper peripheral edge portion 28 along top peripheral edge 29 and extend downwardly on the inside of container 12. Folded-back flaps 30, 32, 34 and 36 cover or extend over interlocking areas of upper peripheral edge portion 28. Flaps 30, 32, 34 and 36 include upper wall portions 38 spaced from sidewall 16 (see FIGS. 4 and 5), and lower wall portions 40 adhesively attached to sidewall 16.

Elongate openings 42 are formed in upper peripheral edge portion 28 in each of the opposed interlocking areas of the sidewall panels 20, 22, 24 and 26. Side panels 20, 22 each have one opening 42 and side panels 24, 26 have two spaced-apart openings 42. However, a single opening 42 could be formed in all of the side panels or two or more openings 42 could be formed in all of the side panels depending upon the size of container 12. For smaller containers, it may only be necessary to form openings 42 on two of the opposed side panels.

Figure 5:
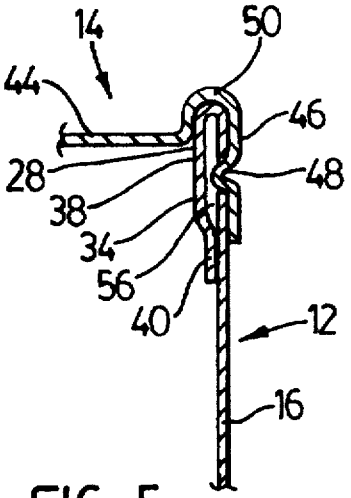
FIG. 5 is a partial sectional view taken along lines 5—5 of FIG. 1; but showing the lid and container in the assembled configuration.

Container lid 14 has a top, horizontal member 44 and a peripheral flange 46 adapted to telescopically engage the container sidewall upper peripheral edge portion 28 as seen best in FIG. 5. Peripheral flange 46 includes opposed, inwardly extending projections 48 adapted to be located in or pass through openings 42 to retain lid 14 on container 12. Projections 48 are elongate horizontally and are slightly smaller than openings 42, so that projections 48 fit snugly into openings 42.

Lid 14 has an inverted U-shaped top peripheral edge portion 50 adapted to engage snugly the container upper peripheral edge portion 28 as seen best in FIG. 5. Lid top member 44 is thus recessed slightly from the top peripheral edge of lid 14. Projections 48 are located below the inverted U-shaped top peripheral edge portion 50 a distance to match the spacing between container top peripheral edge 29 and openings 42. Preferably, the inside width of U-shaped edge portion 50 is such that the container peripheral edge portion 28 is compressed slightly to give a good seal between lid 14 and container 12.

Lid 14 preferably is formed of transparent food grade plastic to make the contents of container 12 visible. However, lid 14 could be made of translucent or opaque plastic or any other suitable material. Container 12 is preferably formed of cardboard or card stock, but again it could be made of any other suitable material.

Referring next to FIG. 6, a blank 52 is shown for forming container 12. As is usual in the folding carton industry, the various panels and flaps of blank 52 are separated by creases or score lines as indicated by chain dotted lines. Crease lines 54 between panels 24, 20, 26 and 22 and respective folded-back flaps 34, 36, 30 and 32 are three point creases to provide hollow spaces 56 between upper wall portions 38 and upper peripheral edge portion 28, as seen best in FIGS. 4 and 5. Creases 58 in folded-back flaps 34, 36, 30 and 32 make these flaps stepped for the same purpose. Lines of adhesive 60 are used to attach the lower wall portions 40 of folded-back flaps 34, 36, 30 and 32 to sidewall 16 of container 12. Beads of adhesive 62 are located adjacent to openings 42 near creases 54 to act as spacers between upper peripheral edge portion 28 and the adjacent upper wall portion 38 of folded-back flaps 34, 36, 30 and 32. Spacers 62 help keep hollow spaces 56 from collapsing. Preferably a hot melt adhesive is used for the lines of adhesive 60 and the beads of adhesive 62.

Blank 52 has an additional side flange 64 adhesively attached to the outside of panel 24 to form a partially formed container 66 as shown in FIG. 7.

Referring next to FIG. 7, partially formed container 66 is a tubular, collapsed container wherein peripheral sidewall 16 includes lower, hingeably mounted flaps 68, 72 which are adapted to fold inwardly and overlap to form bottom closure 18 upon expansion of the collapsed container 66. As mentioned above, the configuration of the bottom flaps 68, 70 is not considered to be part of the present invention and can be in any form desired. The collapsed or partially formed container 66 is normally flat, but is shown partly opened in FIG. 7 for the purposes of illustration. The upper peripheral edge portion of sidewall 16 has two pairs of opposed interlocking areas upon expansion of collapsed container 66 as described above.

In the collapsed form shown in FIG. 7, sidewall 16 has two opposed sides each having two adjacent, rectangular hinged side panels, thus forming a rectangular container upon expansion of partially formed container 66. When partially formed container 66 is expanded, bottom closure 18 in the embodiment shown in FIGS. 6 and 7 is formed by first folding inwardly flaps 68 and then folding flaps 72 on top of flaps 68, with the two flaps 72 overlapping. A suitable adhesive is used to seal all the flaps together.

Figure 8:
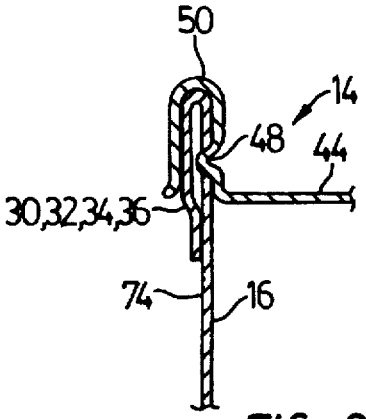
FIG. 8 is a partial sectional view similar to FIG. 5 but showing another embodiment of the present invention.

FIG. 8 shows another embodiment wherein the folded-back flaps 30, 32, 34 and 36 extend downwardly over the outside surface 74 of sidewall 16. In this embodiment, the top member 44 of lid 14 is located further below the U-shaped edge portion 50 than is the case with the embodiment shown in FIG. 5, and projections 48 are located on the inside of the inner leg of U-shaped edge portion 50. Otherwise, the embodiment of FIG. 8 is substantially the same as the embodiment of FIG. 5.

Figure 9:
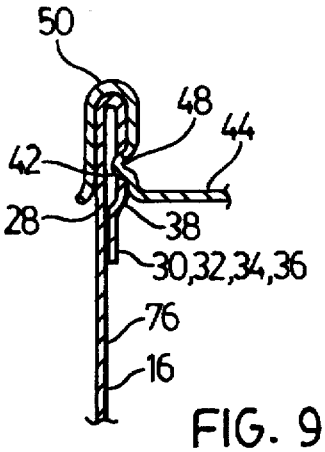
FIG. 9 is a partial sectional view similar to FIGS. 5 and 8, but showing yet another embodiment of the present invention.

The embodiment shown in FIG. 9 is similar to the embodiment shown in FIG. 8, but it will be noted that the folded-back flaps 30, 32, 34 and 36 extend downwardly on the inside surface 76 of sidewall 16 as in the embodiment shown in FIGS. 1 to 7. In this embodiment, however, openings 42 are formed in upper wall portions 38 of folded-back flaps 30, 32, 34 and 36 rather than in the upper peripheral edge portion 28 of sidewall 16.

Having described preferred embodiments of the invention, it will be appreciated that various modifications can be made to the structures described above. For example, instead of forming openings 42 in container 12 and projections 48 in lid 14, it will be appreciated that this could be reversed, so that the projections are in sidewall 16 of container 12 and the openings 48 are formed in the peripheral flange 46 of lid 14. Openings 42 and projections could be other shapes than oblong as shown. For example, they could be circular, square or triangular. Further, the shape of projections 48 does not have to match the shape of openings 42. For example, a triangular or square projection could be made to fit into a circular hole, or vice versa. Also, container 12 and lid 14 have been described as being rectangular in shape but the container and lid assembly 10 could be round or circular, with container 12 being in the form of a circular tube, if desired.

It will be apparent to those skilled in the art that in light of the foregoing disclosure, many alterations and modifications are possible in the practise of this invention without departing from the spirit or scope thereof. Accordingly, the scope of the invention is to be construed in accordance with the substance defined in the following claims.

What we claim is:

1. An interlocking container and lid, comprising:

a tubular container having a peripheral sidewall and a bottom closure; the sidewall including an upper peripheral edge portion having at least two opposed interlocking areas; folded-back flaps connected to the upper peripheral edge portion extending over the interlocking areas, the flaps including an upper wall portion spaced from the sidewall and a lower wall portion adhesively attached to the sidewall, means defining an opening in one of said upper wall portion and the upper peripheral edge portion in each of the opposed interlocking areas; and a container lid having a top member and a peripheral flange adapted to telescopically engage the container sidewall upper peripheral edge portion, the peripheral flange including opposed projections adapted to pass through said openings to retain the lid on the container.

2. An interlocking container and lid as claimed in claim 1 wherein said openings are formed in the upper peripheral edge portion.

3. An interlocking container and lid as claimed in claim 2 wherein the folded-back flaps are located on the inside of the container.

4. An interlocking container and lid as claimed in claim 2 and further comprising an adhesive spacer located between the upper peripheral edge portion and said upper wall portion adjacent to each of said openings.

5. An interlocking container and lid as claimed in claim 2 wherein the container is rectangular having two pairs of opposed side panels, said openings being formed on all said side panels.

6. An interlocking container and lid as claimed in claim 5 wherein at least some of the side panels are formed with a plurality of said openings.

7. An interlocking container and lid as claimed in claim 1 wherein the container lid has an inverted U-shaped top peripheral edge portion adapted to engage the container upper peripheral edge portion.

8. An interlocking container and lid as claimed in claim 7 wherein the lid is formed of plastic.

9. An interlocking container and lid as claimed in claim 7 wherein the projections are located below said inverted U-shaped top peripheral edge portions.

10. An interlocking container and lid as claimed in claim 7 wherein the projections extend inwardly toward the top member.

11. A partially formed container comprising:

a tubular, collapsed container having a peripheral sidewall including lower, hingeably mounted flaps adapted to fold inwardly and overlap to form a bottom closure upon expansion of said collapsed container; the sidewall including an upper peripheral edge portion having at least two opposed interlocking areas upon expansion of said collapsed container; folded-back flaps connected to the upper peripheral edge portion extending over the interlocking areas; the flaps including an upper wall portion spaced from the sidewall and a lower wall portion adhesively attached to the sidewall, and means defining an opening in one of said upper wall portion and the upper peripheral edge portion in each of the opposed interlocking areas.

12. A partially formed container as claimed in claim 11 wherein said openings are formed in the upper peripheral edge portion.

13. A partially formed container as claimed in claim 12 wherein the folded-back flaps are located on the inside of the tubular collapsed container.

14. A partially formed container as claimed in claim 12 wherein the peripheral sidewall has two opposed sides each having two rectangular hinged side panels thus forming a rectangular container upon expansion of said collapsed container.

15. A partially formed container as claimed in claim 14 wherein said openings are formed on all four hinged side panels.

16. A partially formed container as claimed in claim 15 wherein at least some of the hinged side panels are formed with a plurality of openings therein.

17. A partially formed container as claimed in claim 12 and further comprising an adhesive spacer located between the upper peripheral edge portion and said upper wall portion adjacent to each of said openings.

* * * * *